US005106153A

United States Patent [19]

Durling

[11] Patent Number: 5,106,153

[45] Date of Patent: Apr. 21, 1992

[54] UNIT OF FURNITURE

[76] Inventor: Walter E. Durling, 851 Coley Rd., Tupelo, Miss. 38801

[21] Appl. No.: 609,361

[22] Filed: Nov. 5, 1990

[51] Int. Cl.[5] ..... A47C 7/62

[52] U.S. Cl. ..... 297/232; 297/135; 297/170; 297/194

[58] Field of Search ..... 297/112, 113, 135, 170, 297/194, 232, 411, 145; 312/270

[56] References Cited

U.S. PATENT DOCUMENTS

| | | | |
|---|---|---|---|
| 2,418,092 | 3/1947 | Passel | 297/227 |
| 2,859,803 | 11/1958 | McCallister | 297/245 |
| 3,237,824 | 3/1966 | Gunckel | 297/194 X |
| 3,338,629 | 8/1967 | Drees | 297/194 |
| 3,632,157 | 1/1972 | Lohr | 297/232 X |
| 3,893,729 | 7/1975 | Sherman et al. | 297/232 X |
| 4,685,729 | 8/1987 | Heesch et al. | 297/113 X |
| 4,934,750 | 6/1990 | Eichler et al. | 297/194 X |
| 4,986,589 | 1/1991 | McNew | 297/194 X |

FOREIGN PATENT DOCUMENTS

| | | | |
|---|---|---|---|
| 59046 | 4/1954 | France | 297/227 |
| 277439 | 9/1927 | United Kingdom | 297/194 |

*Primary Examiner*—Peter R. Brown
*Attorney, Agent, or Firm*—Clifton Ted Hunt

[57] ABSTRACT

A unit of household furniture has two chairs and a console permanently joined together with the console between the two chairs. Each of the chairs is a reclining chair that is individually adjustable between a retracted position and an extended position, and the two chairs and console are movable as a unit relative to a supporting surface.

12 Claims, 4 Drawing Sheets

UNIT OF FURNITURE

FIELD OF THE INVENTION

This invention is a piece of furniture comprising a pair of reclining chairs and a table-top between the chairs.

BACKGROUND OF THE INVENTION

Reclining chairs are well known and table-tops are well known, but to applicant's knowledge a table-top has not heretofore been combined with a pair of reclining chairs to define a unit of furniture.

SUMMARY OF THE INVENTION

This invention is a unit of furniture comprising two reclining chairs and a table-top between the chairs. In one embodiment of the invention, the table-top is the upper surface of a console having a drawer with a sliding top. A tray is slidably mounted in the upper part of the drawer.

The tray is removable from the drawer to be used in a conventional way, such as carrying food and beverages to the console. Removal of the tray also permits access to the storage area in the bottom of the drawer.

In another embodiment of the invention, the console beneath the table-top does not have a drawer but has storage space which is made accessible by hinging the table-top to the top of the console. An armrest may be hinged to the top of the console behind the table-top.

Each of the recliners may have a storage tray built into the arm of the recliner. The storage tray is normally concealed by a cushioned armrest hinged to the arm of the recliner.

The double recliner and table-top of this invention has the advantage of saving space while combining the comfort of the recliners with the convenience and accessibility of the table-top and storage space in the console between the chairs.

Another advantage of the invention is the convenience of the concealed but readily accessible storage space within the arms of the recliners.

A further advantage is the flexible arrangement of the embodiment having a drawer within the console. The sliding top of the drawer may be positioned as an extension of the table-top, and the removable tray is conveniently located for the normal use of a tray, while providing a convenient location within the drawer for the remote controls of a television and VCR and for a variety of other household accessories.

DETAILED DESCRIPTION OF THE INVENTION

Figure 1:
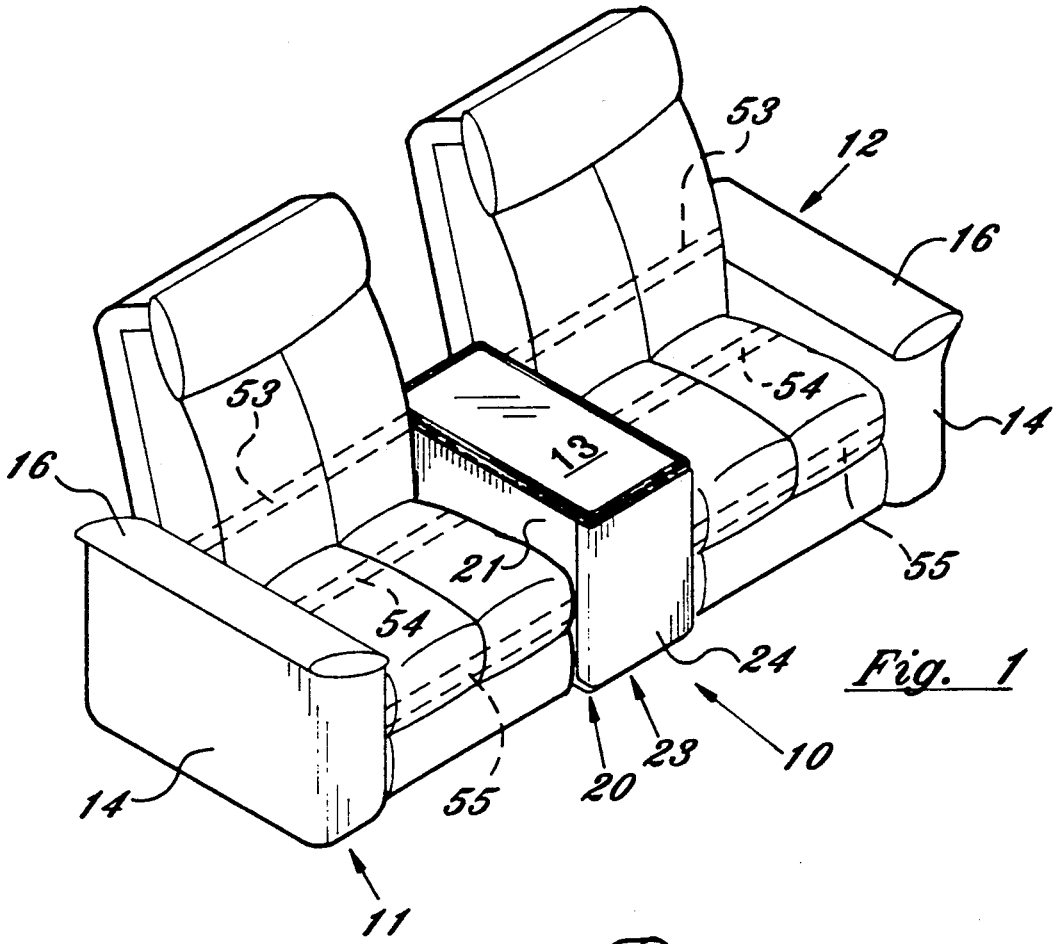
FIG. 1 is a perspective view of a unit of furniture including two recliners and a table-top as the top of a console having a drawer.
Figure 2:
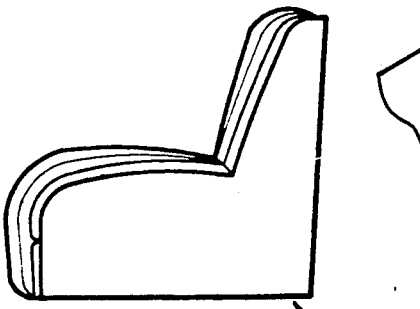
FIG. 2 is a side view showing one of the recliners in the unit of furniture in the retracted position, omitting the arm for the purpose of illustration.
Figure 4:
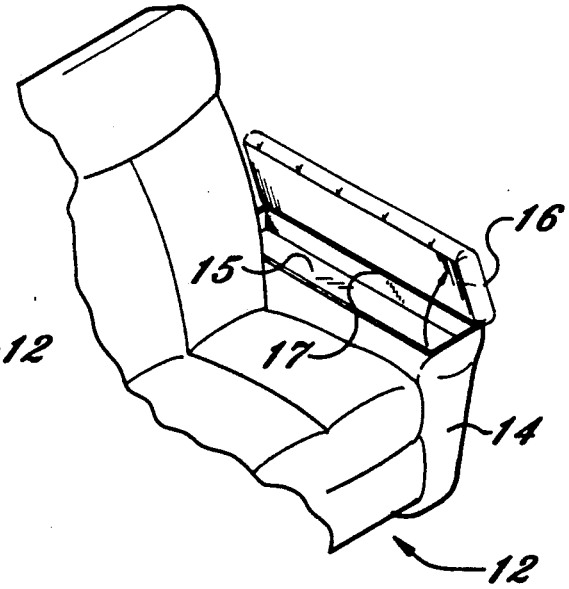
FIG. 4 is an enlarged perspective view, with parts broken away, showing one of the recliners with a hinged armrest in the open position.
Figure 3:
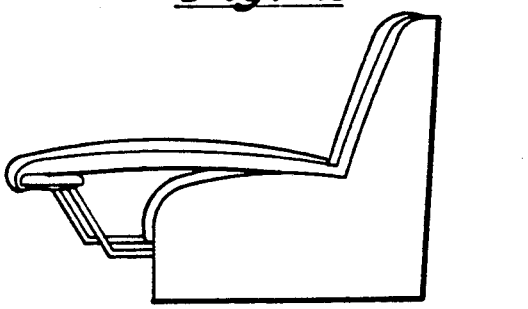
FIG. 3 is a side view of the same recliner in the extended position.
Figure 5:
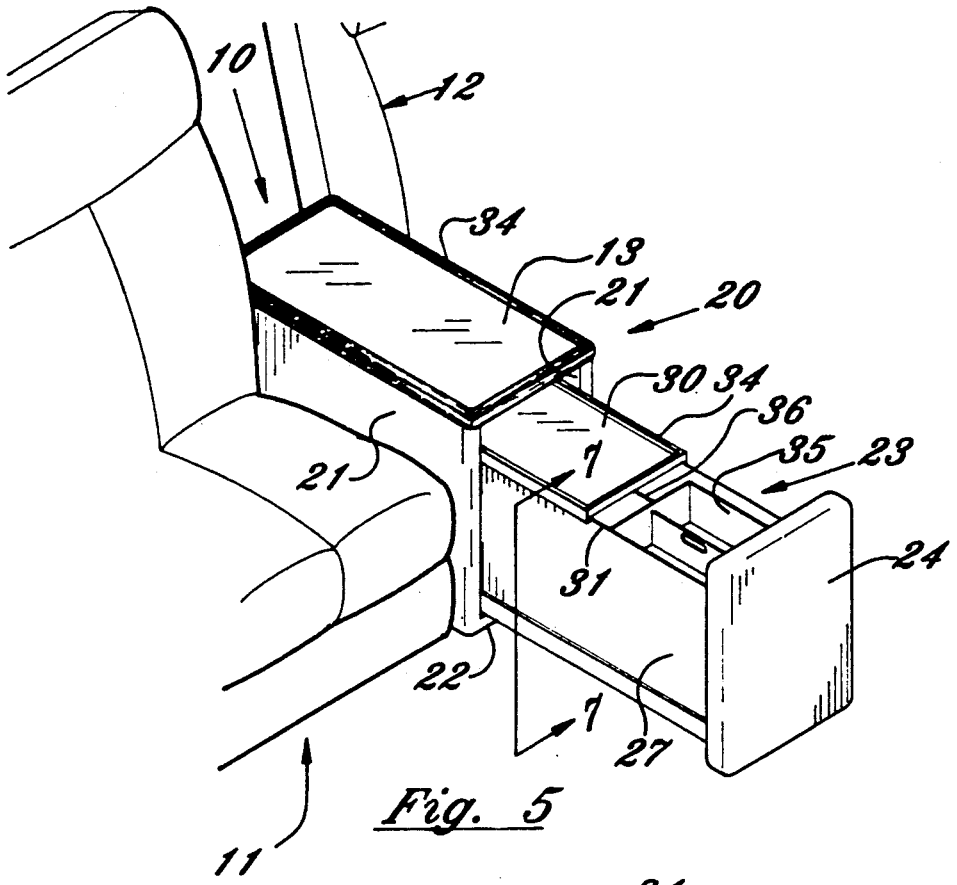
FIG. 5 is an enlarged fragmentary perspective view, with parts broken away, of the unit of furniture shown in FIG. 1 with the drawer of the console open and the sliding drawer top retracted to expose the sliding tray within the drawer.
Figure 6:
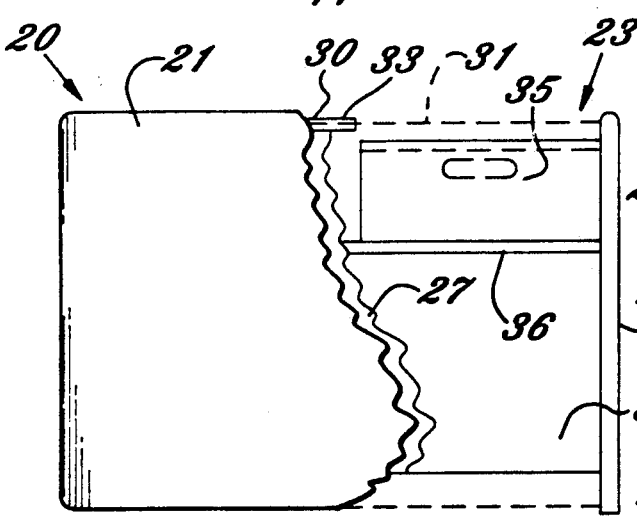
FIG. 6 is a side view of the console shown in FIG. 5 with parts broken away to show the sliding top of the drawer and the sliding and removable tray within the drawer.
Figure 7:
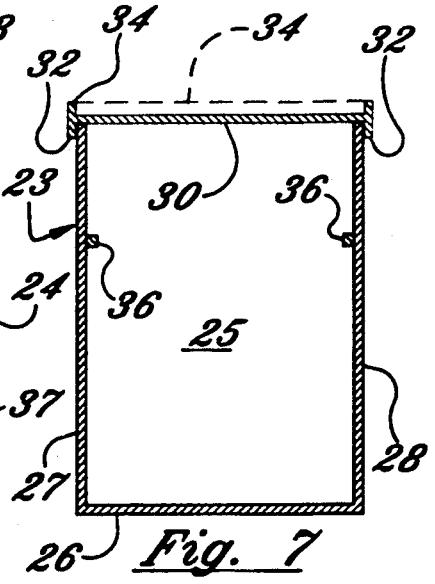
FIG. 7 is a sectional view taken substantially along the line 7—7 in FIG. 5.
Figure 9:
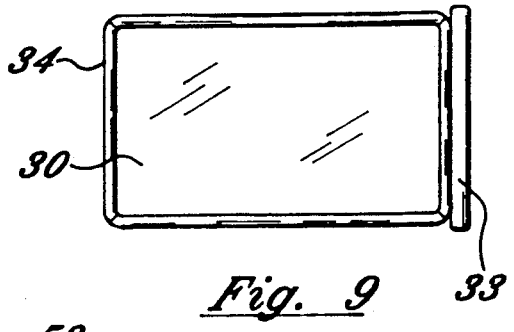
FIG. 9 is a top plan view of the sliding top removed from the console.

Referring more specifically to the drawings, the unit of furniture or double recliner and table-top illustrated in FIGS. 1-9 is broadly indicated at 10. As used herein, the term double recliner and table-top refers to a unit of furniture comprising two reclining chairs, a table-top between them, and a frame uniting the two recliners and the table-top into a unit of furniture.

The double recliner and table-top 10 comprises reclining chairs broadly indicated at 11 and 12 and a table-top 13 between the chairs 11 and 12. The table-top 13 is a planar surface lying in a generally horizontal plane and of a width defining the space between the chairs 11 and 12.

The reclining mechanism of the chairs 11 and 12 is not a part of this invention and may be conventional or otherwise, as desired. The chairs 11 and 12 have arms 14 at the ends of the unit but do not have arms on their sides proximal to each other. Although not critical, the width of the table-top 13 is twelve (12) inches, which generally corresponds to the combined width of two arms on a typical reclining chair.

One or both of the arms 14 may have a recessed opening or storage area 15 in the top of the arm. The storage area 15 is normally covered by an armrest 16 hinged as at 17 to its corresponding arm 14. The storage areas 15 provide convenient storage for small items, such as smoker's accessories, sewing supplies, and the like.

The table-top 13 is the upper surface of a console, broadly indicated at 20, including side walls 21 and a bottom wall 22. A drawer 23 is slidably mounted between the side walls 21, the table-top 13 and the bottom wall 22 of the console.

The drawer 23 has a front wall 24, rear wall 25, bottom wall 26, side walls 27 and 28, and a top 30 slidably mounted on upper edges 31 of the side walls 27, 28. The width of the sliding top 30 corresponds to the overall width of the drawer 23 with the longitudinal sides of the top 30 overlying the upper edges 31 of the drawer and guides 32 depending from the sides of the top 30 and extending along the outer surfaces of the upper portions of the side walls 27 and 28.

The length of the top 30 is preferably about half the length of the drawer. The drawer top 30 may be slid between the front wall 24 and rear wall 25 of the drawer to expose the interior of the uncovered portion of the drawer. Another advantage of the sliding top 30 is that it may serve as a temporary extension of the table-top 13 by opening the drawer 23 and positioning the sliding top 30 to extend from beneath the table-top 13, as in FIG. 5. A stop 33 (FIG. 8) is provided to prevent the top 30 from sliding beyond the rear of the drawer when the drawer is opened, as in FIG. 5.

Upstanding rims 34 preferably extend about the peripheries of the table-top 13 and the sliding top 30 as safeguards against the leakage of liquid spillage.

A tray 35 is slidably mounted within the drawer 23 on longitudinal rails 36 secured to the inner surfaces of opposed side walls 27, 28 and extending between front wall 24 and rear wall 25 of the drawer 23. The width of the tray corresponds to the distance between the side walls 27 and 28 and the length of the tray is preferably about the same as the length of the sliding top 30, or about half the length of the drawer 23. The tray is spaced far enough below the upper edges 31 of the drawer 23 to prevent the tray from blocking the path of the top 30 as it slides along the top of the drawer. The depth of the tray 35 is relatively shallow compared with the depth of the drawer 23 so that a sizable storage space 37 (FIG. 6) is provided in the drawer beneath the tray.

Figure 10:
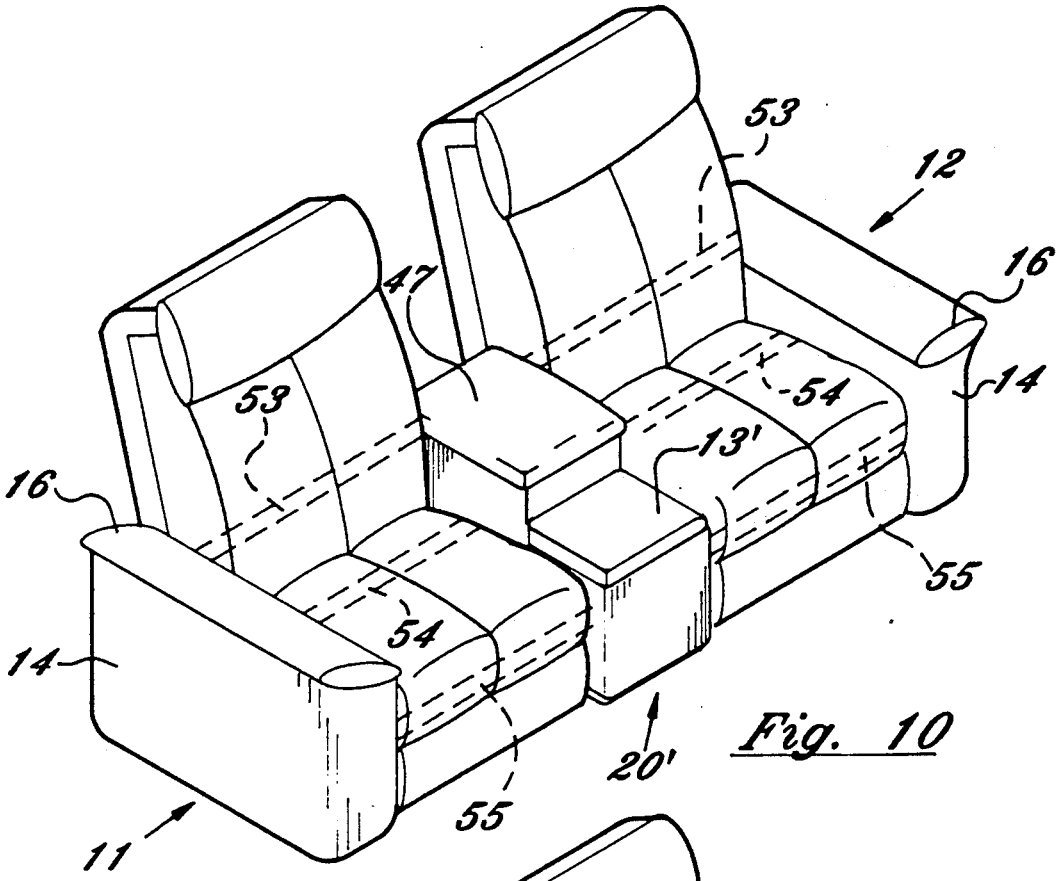
FIG. 10 is a perspective view of another embodiment of the invention.

The tray 35 comprises a bottom wall 40, front wall 41, rear wall 42, side walls 43 and 44, and a center wall 45 extending between the front wall 41 and rear wall 42 (FIG. 10). The center wall 45 has a hand hold 46 cut through its medial portion to facilitate lifting the tray from the drawer and replacing it. of a tray, such as transporting food and beverages to the console, and it may be used for the storage of articles within the console.

Figure 11:
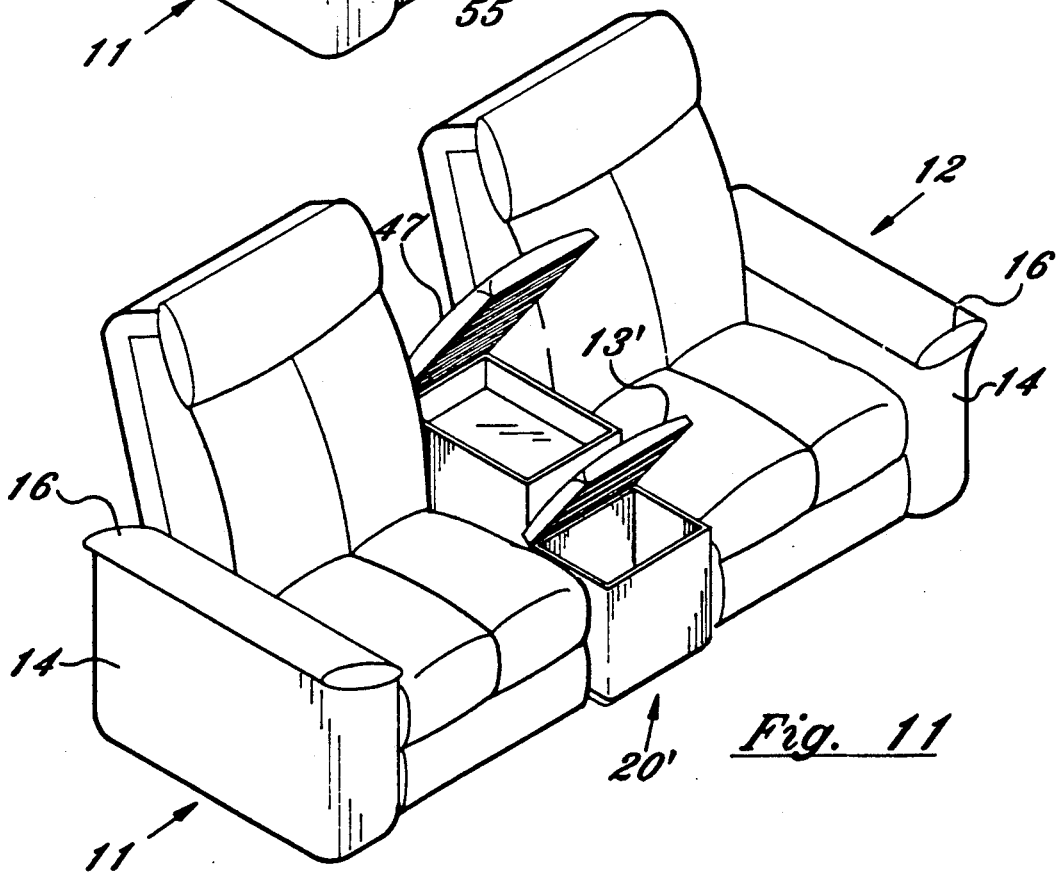
FIG. 11 is a perspective view of the embodiment of FIG. 10, illustrating that the table-top and armrest may be hinged to the console.

Referring to FIGS. 10 and 11, a less expensive embodiment of the invention is illustrated, with common parts bearing the same reference characters as like parts in the previously described embodiment of the invention. Comparable but distinctive parts bear the same reference characters with the prime notation added, and parts not previously described bear their own reference characters.

The console $20^1$ does not have a drawer. It does provide storage space between the reclining chairs 11 and 12, and access to the storage space within the console $20^1$ is obtained by attaching table-top $13^1$ for movement relative to the console, as by hinging it to the top of the console $20^1$, as shown in FIG. 11.

Additional comfort for the occupants of the recliners 11 and 12 in the embodiment of FIGS. 10 and 11 may be obtained by providing a cushioned armrest 47 on top of the console $20^1$, behind the table-top $13^1$. The armrest 47 may be hinged to the top of the console $20^1$, as shown in FIG. 11.

Figure 12:
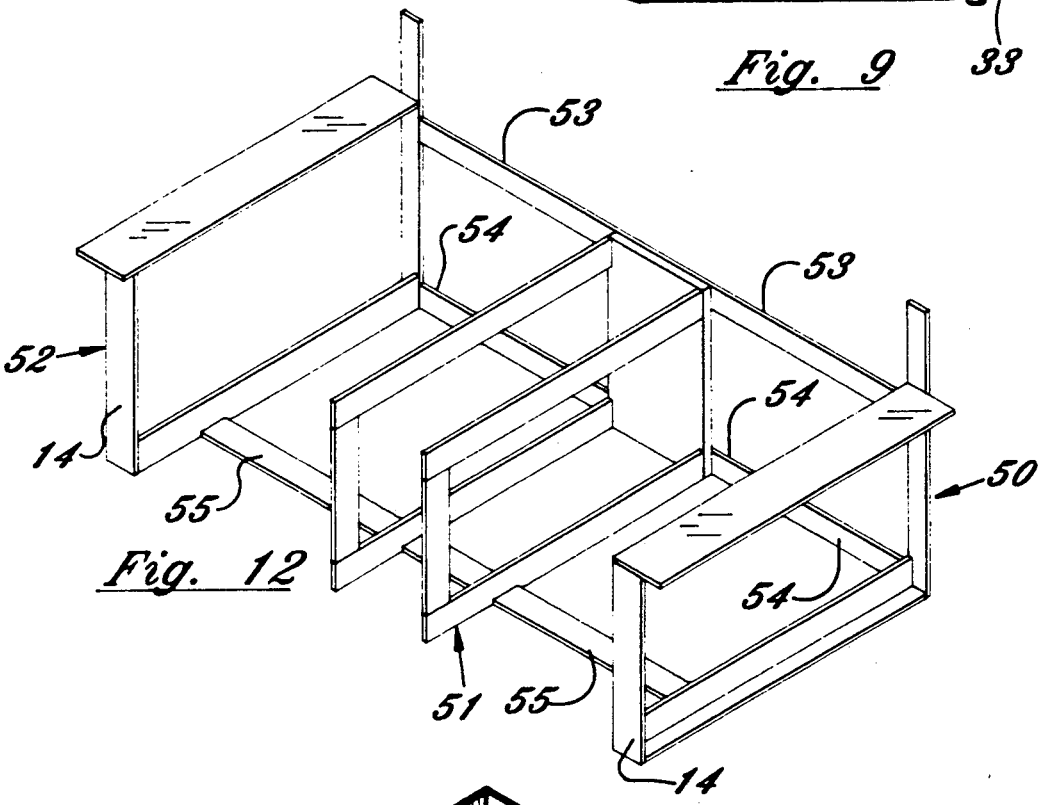
FIG. 12 is a perspective view of a supporting frame which may be used with both of the illustrated embodiments to unite the two recliners and table-top into a unit of furniture.
Figure 8:
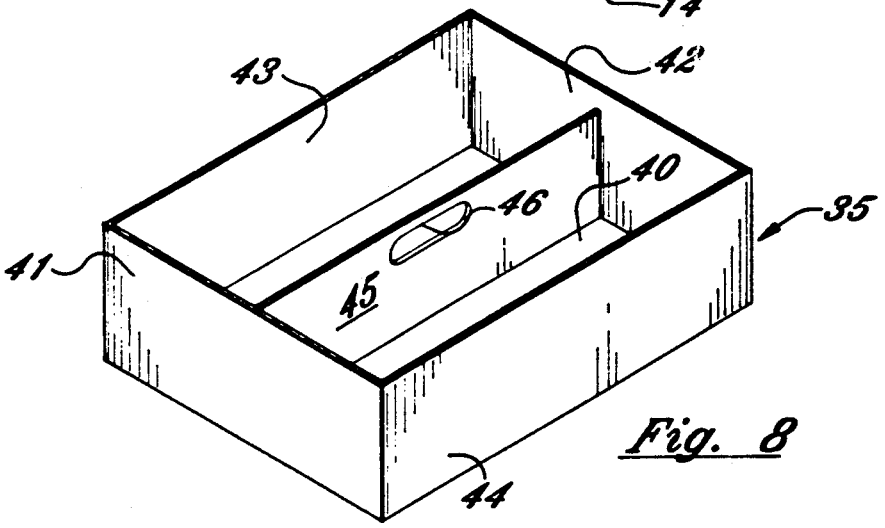
FIG. 8 is a perspective view of the tray removed from the console.

Referring to FIG. 12, a frame section broadly indicated at 50 supports reclining chair 12, a frame section broadly indicated at 51 supports the console 20 or $20^1$, and a frame section broadly indicated at 52 supports the reclining chair 14.

Rails 53, 54, and 55 are connected to frame sections 50, 51, and 52 to define a common frame and to join the two recliners 12, 14 and the console 20 or $20^1$ into a unit of furniture, as illustrated by the dotted line showing of the rails in FIGS. 1 and 10.

Two reclining chairs are thus combined with a table-top between them to define a novel and practical unit of furniture.

Although specific terms have been employed in describing the invention, they have been used in a generic and descriptive sense only and not for the purpose of limitation.

I claim:

1. A unit of household furniture having two chairs and a console including a storage receptacle, said chairs and console being permanently joined together with the console between the two chairs and the two chairs and console being movable as a unit relative to a supporting surface, wherein the improvement comprises:

(a) each of the chairs being a reclining chair that includes means for individually adjusting that reclining chair between a retracted position and an extended position;

(b) a box-type frame section for supporting each reclining chair;

(c) a box-type frame section for enclosing the console;

(d) rails extending between the box-type frame sections for the two reclining chairs and across the frame section for the console, and (e) the rails being connected to each frame section to define a common frame and to join the two reclining chairs and the console into a unit of household furniture.

2. A unit of furniture according to claim 1 wherein at least one of the reclining chairs includes an arm and an armrest.

3. A unit of furniture according to claim 2 wherein the arm has a storage cavity underlying the armrest, and means attaching the armrest to the arm for movement relative to the arm, whereby access may be had to the storage cavity in the arm by moving the armrest.

4. A unit of furniture according to claim 1 wherein an armrest is attached to the top of the console.

5. A unit of furniture according to claim 1 wherein an armrest is hinged to the console.

6. A unit of furniture according to claim 2 wherein the console includes a drawer with a sliding top.

7. A unit of furniture according to claim 6 wherein the drawer is normally housed in the console beneath the top of the console and is extensible beyond the front of the console, whereby the sliding- top of the drawer may be positioned as an extension of the top of the console.

8. A unit of furniture according to claim 7 wherein upstanding rims extend about the peripheries of the top of the console and the sliding top.

9. A unit of furniture according to claim 6 wherein a tray is slidably mounted within the drawer.

10. A unit of furniture according to claim 10 wherein the tray is removable from the drawer.

11. A unit of household furniture according to claim 1 wherein the console is in the place of arms on the sides of the reclining chairs that are proximate to the console.

12. A unit of household furniture according to claim 1 wherein the reclining chairs are upholstered.

* * * * *